US008418931B2

(12) United States Patent
Meyer

(10) Patent No.: US 8,418,931 B2
(45) Date of Patent: Apr. 16, 2013

(54) HEAT EXCHANGER WITH INTEGRAL THERMOSTATS

(75) Inventor: Robert Hornblower Meyer, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1364 days.

(21) Appl. No.: 12/111,827

(22) Filed: Apr. 29, 2008

(65) Prior Publication Data

US 2009/0266311 A1 Oct. 29, 2009

(51) Int. Cl.
*F01P 7/10* (2006.01)

(52) U.S. Cl.
USPC ..... 236/34.5; 236/34; 165/51; 165/52; 165/103; 165/296; 165/297; 165/298; 123/41.01; 123/41.02; 123/41.05; 123/41.08; 123/41.34

(58) Field of Classification Search ..... 236/34, 236/34.5; 165/51, 52, 103, 296–298; 123/41.01, 123/41.02, 41.05, 41.08, 41.34
See application file for complete search history.

(56) References Cited

U.S. PATENT DOCUMENTS

| | | | | |
|---|---|---|---|---|
| 3,255,740 | A * | 6/1966 | Walsh | 123/41.09 |
| 3,604,502 | A * | 9/1971 | Morse et al. | 165/51 |
| 4,337,733 | A | 7/1982 | Hirata et al. | |
| 4,425,877 | A | 1/1984 | Fritzenwenger et al. | |
| 4,432,410 | A | 2/1984 | Cadars | |
| 4,964,371 | A | 10/1990 | Maeda et al. | |
| 5,305,826 | A | 4/1994 | Couetoux | |
| 5,526,873 | A * | 6/1996 | Marsais et al. | 165/51 |
| 6,471,133 | B1 | 10/2002 | O'Flynn et al. | |
| 6,799,631 | B2 | 10/2004 | Acre | |
| 6,942,023 | B2 * | 9/2005 | Fang et al. | 165/140 |
| 6,997,143 | B2 | 2/2006 | Piccirilli et al. | |
| 7,063,048 | B2 | 6/2006 | Ieda | |
| 7,249,575 | B2 | 7/2007 | Pottie et al. | |
| 7,673,592 | B2 * | 3/2010 | Makuta | 123/41.09 |
| 7,699,028 | B2 * | 4/2010 | Guerrero et al. | 123/41.29 |
| 2006/0076129 | A1 * | 4/2006 | Eliades et al. | 165/297 |

FOREIGN PATENT DOCUMENTS

| | | |
|---|---|---|
| DE | 19854544 | 6/2000 |
| GB | 1295767 | 11/1972 |
| JP | 60128924 A * | 7/1985 |
| WO | 2007/040987 | 4/2007 |

OTHER PUBLICATIONS

ISA United Kingdom, International Search Report of GB0816451.9, Nov. 20, 2008, 1 page.

* cited by examiner

*Primary Examiner* — Frantz Jules
*Assistant Examiner* — Azim Abdur Rahim
(74) *Attorney, Agent, or Firm* — Julia Voutyras; Alleman Hall McCoy Russell & Tuttle LLP

(57) ABSTRACT

A system for cooling an engine is described. The system includes a heat exchanger having a first heat exchange portion that removes heat energy from coolant fluid flowing therein, and a second heat exchange portion that removes heat energy from coolant fluid flowing therein; a first thermostat integral to the heat exchanger and fluidically and mechanically coupled to at least one of the first and second heat exchange portions; and a second thermostat, integral to the heat exchanger and fluidically and mechanically coupled to at least one of the first and second heat exchange portions.

19 Claims, 5 Drawing Sheets

HEAT EXCHANGER WITH INTEGRAL THERMOSTATS

BACKGROUND AND SUMMARY

Cooling of internal combustion engines is commonly achieved by way of a cooling system that includes a radiator that receives a coolant fluid flow from the engine and removes heat energy there from. The coolant fluid is then returned to the engine, absorbing heat energy there from, and thereby cooling the engine prior to circulating back to the radiator. Additional engine components, however, may operate more efficiently when cooled with coolant fluid that is within a different temperature range than the temperature range of the coolant fluid circulated back to the engine.

One example of such a cooling system is described in U.S. Pat. No. 6,997,143. In the cooling system in U.S. Pat. No. 6,997,143, a radiator receives a liquid coolant from an internal combustion engine via an inlet section. A portion of the liquid coolant received from the engine may be directed by the inlet section to a by-pass section, where no substantial heat transfer occurs, and then discharged from the radiator. A portion of the liquid coolant received from the engine may be directed by the inlet section to a heat exchange section, where heat energy is removed from the liquid coolant flowing therein. After the temperature of the liquid coolant is thereby reduced, the coolant fluid flow may then be discharged from the heat exchange section (i.e., discharged from the radiator) and returned to the engine. The inlet section may direct variable amounts of coolant fluid flow to a by-pass section and/or to a heat exchange section integral to the radiator, thus varying the volumetric flow rate through both the by-pass section and the heat exchange section. By allowing for variable amounts of liquid coolant to be passed through to both the by-pass section and the heat exchange section (and thus increasing or decreasing the volumetric flow rates there through), the cooling system described in U.S. Pat. No. 6,997,143, may be controlled to discharge liquid coolant that has been cooled to different temperature ranges, depending on current cooling requirements of the internal combustion engine.

The inventors herein have recognized numerous issues with the above approach. In particular, at any given time, the cooling system of U.S. Pat. No. 6,997,143 allows for only a single coolant flow at a specific temperature to be discharged from the heat exchange section. This necessitates that multiple thermostats and/or coolers must be located downstream (i.e., in parallel), of the radiator if multiple liquid coolant streams are to be delivered to the engine and other engine components to facilitate more efficient system-wide cooling.

In one approach, to address the above and other issues, a system for cooling an engine is provided. The system includes, a heat exchanger, the heat exchanger having a first heat exchange portion that removes heat energy from coolant fluid flowing therein, and a second heat exchange portion that removes heat energy from coolant fluid flowing therein; a first thermostat integral to the heat exchanger, the first thermostat fluidically and mechanically coupled to at least one of the first and second heat exchange portions; and a second thermostat, integral to the heat exchanger, the second thermostat fluidically and mechanically coupled to at least one of the first and second heat exchange portions.

By providing a heat exchanger with multiple thermostats arranged integral to the heat exchanger itself, a more versatile cooling system, capable of discharging multiple coolant fluid streams at different temperature ranges to multiple engine components, may be realized.

Furthermore, in one embodiment, porting between a heat exchange portion and a thermostat in such a system can be integral to the heat exchanger. As such, the number of tubes, hoses, connections and associated leak paths may be reduced. In other words, unlike systems in which multiple heat exchangers are arranged separately, the embodiments of the present disclosure described herein below allow for a more compact, simpler, more reliable, and easier to manufacture engine cooling system. The overall cost of the cooling system described herein may thereby be reduced.

DETAILED DESCRIPTION

Figure 1:
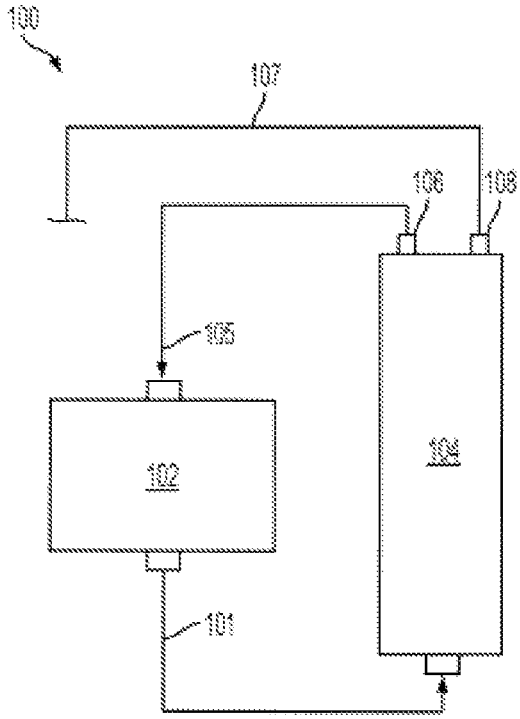
FIG. 1 illustrates a cooling system for cooling an engine and at least one separate engine component according to an embodiment of the present disclosure.

FIG. 1 schematically illustrates a cooling system 100 for cooling an engine 102 and at least one separate engine component (not shown). As one non-limiting example, engine 102 includes a diesel engine that produces a mechanical output by combusting a mixture of air and diesel fuel. Alternatively, engine 102 may include other types of engines such as gasoline burning engines, among others. Further, engine 102 may be configured in a propulsion system for a vehicle. Alternatively, engine 102 may be operated in a stationary application, for example, as an electric generator. While cooling system 100 may be applicable to stationary applications, it should be appreciated that cooling system 100 as described herein, is particularly adapted for vehicle applications.

Cooling system 100 may include one or more of the following: a heat exchanger 104 for removing heat energy from a coolant fluid received form engine 102, and a plurality of thermostats 106 and 108 for allowing coolant of a specified temperature range to pass there through. Cooling system 100 may further include a fan 110 that may blow air around and through heat exchanger 104 and thereby may convectively cool coolant fluid passing through the heat exchanger. Heat exchanger 104 may include a single heat exchange portion or multiple heat exchange portions, and/or a bypass section (not shown in FIG. 1, but described in further detail in regard to FIGS. 2-3). In some embodiments, a portion of coolant fluid received by heat exchanger 104 may bypass any heat exchange portions integral to heat exchanger 104 via the bypass so that a portion of coolant fluid, for example, received from engine 102 (which the coolant fluid has absorbed heat energy from), may be diverted to a separate coolant passage (not shown in FIG. 1) that transfers heat energy to air that is blown into a passenger compartment.

Figure 2:
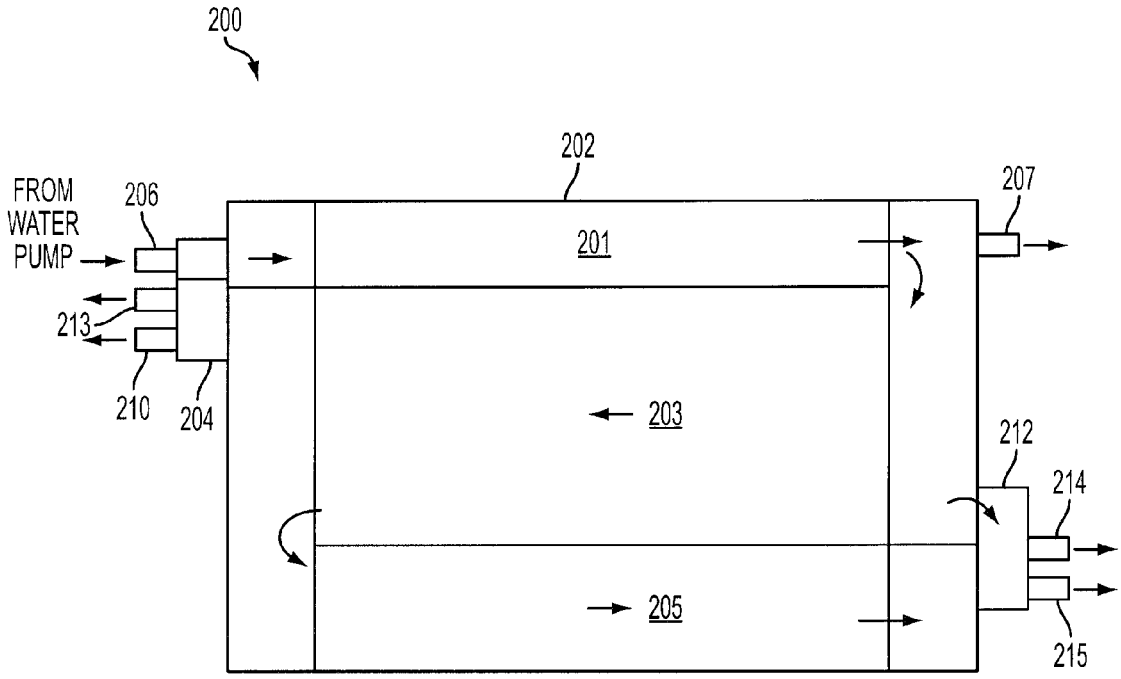
FIG. 2 illustrates a front view of the cooling system of FIG. 1 in greater detail as a longitudinal cross-section according to an embodiment of the present disclosure.
Figure 3:
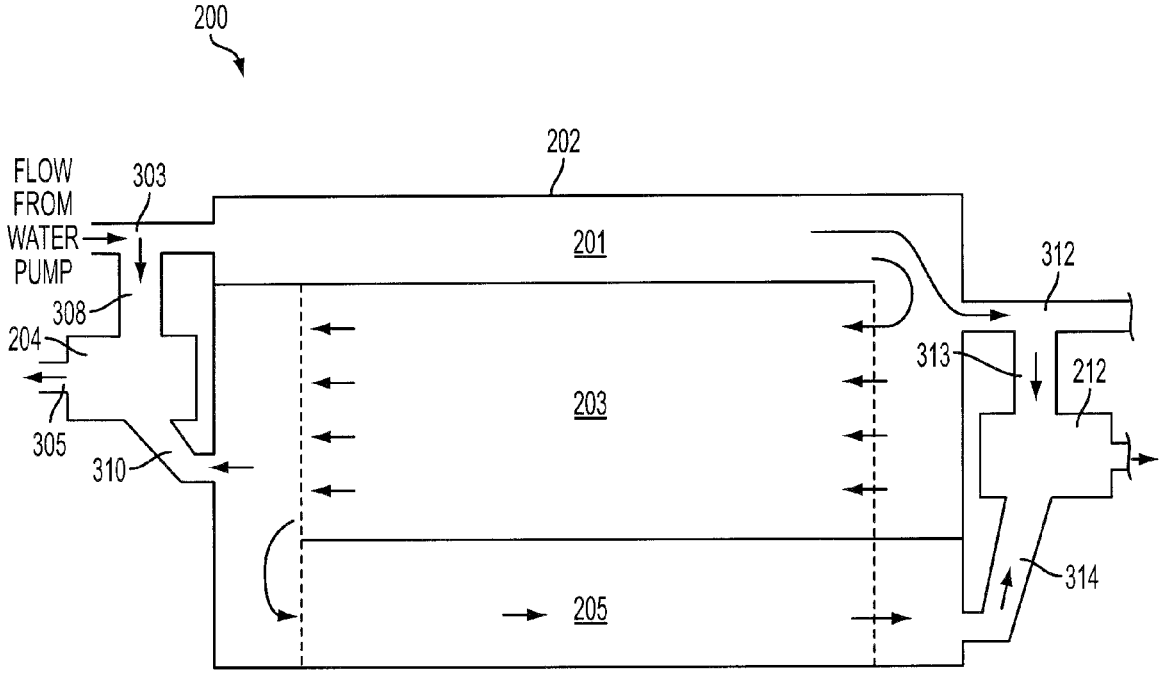
FIG. 3 illustrates a side view of the cooling system of FIG. 1 as a longitudinal cross-section with thermostats and porting shown in greater detail according to an embodiment of the present disclosure.
Figure 4:
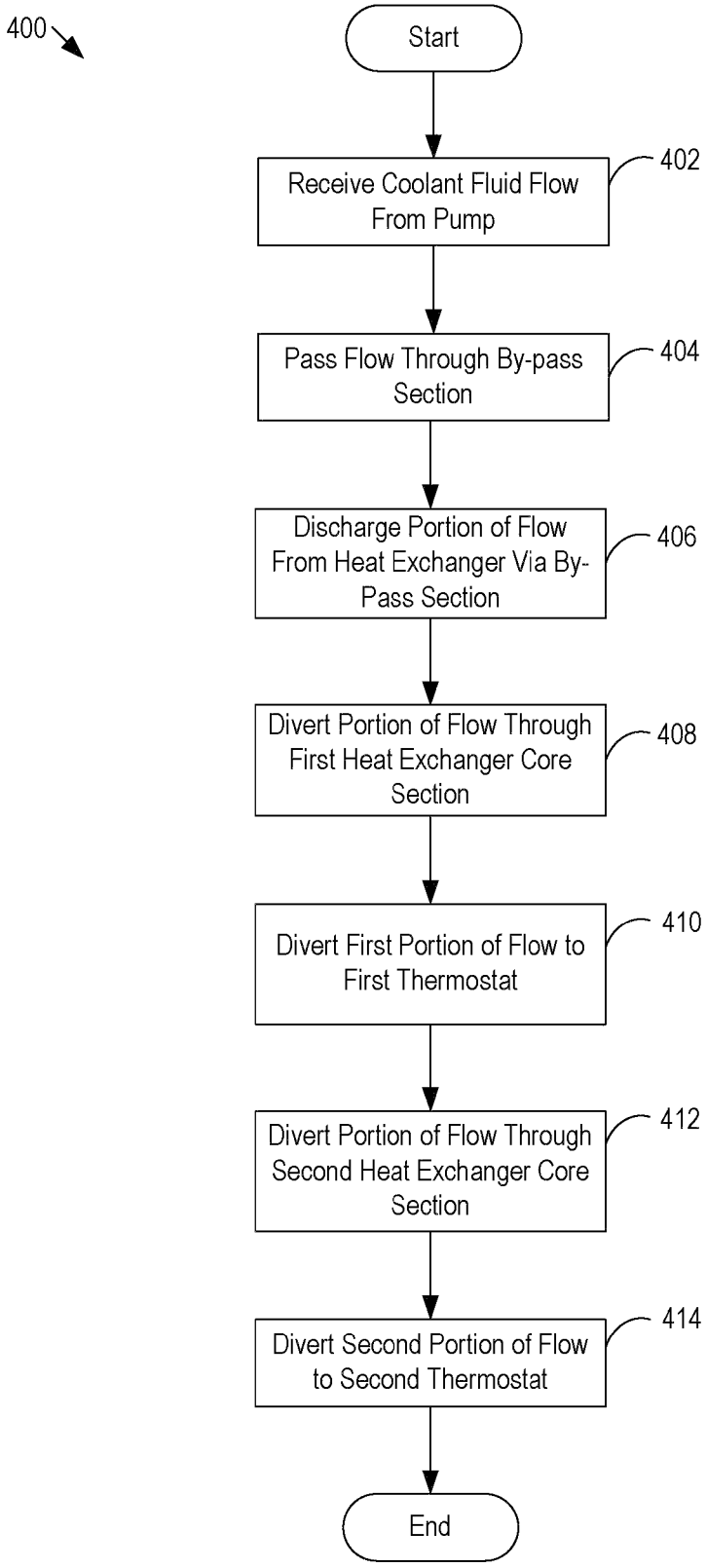
FIG. 4 illustrates a process flow for the transporting and processing of coolant fluid by the cooling system of FIG. 1 according to an embodiment of the present disclosure.

Thermostat 106 may allow coolant fluid that has been passed through a portion of heat exchanger 104 to pass through thermostat 106 and flow to engine 102 as discussed in further detail in regard to FIGS. 2-4). Thermostat 106 may be configured to be temperature sensitive and thus allow only coolant fluid of a specific temperature range to pass through thermostat 106. Similarly, thermostat 108 may allow coolant fluid that has been passed through a portion of heat exchanger 104 to pass through thermostat 108 and flow to engine 102. Additionally, thermostat 108 may be configured to be temperature sensitive and to allow only coolant fluid of a specific temperature range to pass through thermostat 106. Additionally, cooling system 100 may include a plurality of coolant transfer passages for fluidically coupling the various cooling system components. For example, as illustrated by FIG. 1, engine 102 may be fluidically coupled to heat exchanger 104 by coolant transfer passage 101. Similarly, first thermostat 106 may be fluidically coupled to engine 102 by coolant transfer passage 105. Likewise, second thermostat 108 may be fluidically coupled to a separate engine component (not shown in FIG. 1) by coolant transfer passages 107. Furthermore, it should be appreciated that cooling system 100 may include one thermostat, three thermostats, or four thermostats, for example. It should also be appreciated that each separate thermostat may deliver a plurality of coolant streams to the same engine component or to different engine components.

By arranging multiple thermostats integrally (and/or directly coupled) to heat exchanger 104, multiple coolant flows of different temperatures may be delivered to various engine components. In other words, a first engine component that requires a coolant fluid flow of approximately 20° C. and a second engine component that requires a coolant fluid flow of approximately 30° C. may both be supplied with coolant fluid within the particular temperature range at which that engine component requires. Alternatively, in order to achieve this effect, multiple thermostats, separate from a heat exchanger, could be mounted elsewhere in an engine compartment; however, such an arrangement may increase packaging requirements, cost, etc.

Furthermore, by arranging multiple thermostats integrally to heat exchanger 104 (and without any intervening hoses and/or connections), coolant fluid exchange from the heat exchanger to each thermostat may be metered via integral porting. Thus, the number of additional hoses and pipes may be reduced and the overall cost to manufacture such a system according to the present disclosure may be reduced. Also, by reducing the number of hoses/tubes and connections used to convey coolant fluid, the number of leak paths may be reduced and the overall quality of the cooling system may thus be improved. As noted above, the various thermostats may be coupled to a plurality of components, such as EGR coolers, intake air coolers for boosted engines, etc.

FIG. 2 illustrates a front view of a cooling system 200 as a longitudinal cross-section according to an embodiment of the present disclosure. As illustrated, cooling system 200 may include a heat exchanger 202 that may remove heat energy from a coolant fluid received form an internal combustion engine (not shown in FIG. 2) and/or coolant fluid received from other engine component(s) (also not shown in FIG. 2). In this example, heat exchanger 202 is viewed from a vantage point that is in front of a vehicle that heat exchanger 202 is mounted to. Cooling system 200 may further include thermostat 204 and thermostat 212 that are integral to heat exchanger 202. In this illustration, thermostat 204 is shown to be on a passenger side of heat exchanger 202 (i.e., the passenger side of a vehicle to which thermostat 212 is mounted according to U.S. driving conventions). Correspondingly, thermostat 212 is shown to be on a driver side of heat exchanger 202. Although shown as being configured with two thermostats integral to heat exchanger 202, other embodiments may have a heat exchanger with one, three, four or other suitable number of heat exchangers integral thereto. As shown, heat exchanger 202 may receive a coolant fluid from an internal combustion engine via coolant fluid inlet passage 206. In other embodiments, multiple coolant fluid passages may deliver coolant fluid to an individual thermostat. In yet other embodiments, multiple thermostats may receive coolant fluid from a single coolant fluid passage or from multiple coolant fluid passages.

Heat exchanger 202 may be configured with heat exchange portion 203 and heater exchange portion 205 that remove heat energy from a coolant fluid passed there through. Although shown as having two heat exchange portions, other embodiments may have three, four, or five heat exchange portions, for example. Heat exchange portion 203 may be fluidically coupled to heat exchange portion 205 by a fluid passage (not shown in FIG. 2). In other embodiments, heat exchange portion 203 may be fluidically coupled to heat exchange portion 205 by a fluid passage integral (i.e., jumper pipe) to thermostat 212. By allowing for a jumper pipe to be integral to thermostat 212, a more simplified, more reliable, and less costly heat exchanger package may be realized.

Heat exchanger 202 may further include a by-pass section 201. By-pass section 201, for example, may be configured such that it receives a coolant fluid flow from thermostat 204, and passes it on to fluid outlet passage 207 without actively removing any heat energy from the coolant fluid. In other words, it may be desired to substantially maintain the temperature of a coolant fluid received and processed by heat exchanger 202. By passing it through a by-pass section that by-passes heat transfer portions integral to the heat exchanger (i.e., the by-pass section only), the temperature of a coolant fluid passed through the heat exchanger may be substantially maintained. A control valve (not shown in FIG. 2), controlled by an electronic controller (not shown in FIG. 2) may be caused to actuate such that a portion of a coolant fluid flowing through by-pass section 201 is passed directly from the by-pass section to fluid outlet passage 207, thus exiting heat exchanger 202. Any portion of coolant fluid received by heat exchange portion 203, but not allowed to exit the heat exchanger (via by-pass section 201 and fluid outlet passage 207) may then be passed on to heat exchange portion 203 via a jumper pipe (not shown in FIG. 2).

Coolant fluid received by heat exchange portion 203 may be passed through heat exchange conduits included therein (not shown in FIG. 2). In some examples, the heat exchange conduits integral to heat exchange portion 203 (and heat exchange portion 205) may be configured as metal pipes that allow heat energy to be convectively passed from the coolant fluid (flowing therein) through the wall of the metal pipe, to an airflow substantially surrounding the heat exchange conduits. The temperature of the coolant fluid flowing therein may thereby be reduced. A portion of the coolant fluid passed through at least a portion of heat exchange portion 203 may be cooled (to within a temperature range that thermostat 204 will allow to pass there through) may be diverted to thermostat 204, for example, by an electronically controlled valve (not shown). For example, thermostat 204 may be configured to allow coolant fluid at approximately 45° C. to pass there through (and thereby exit heat exchanger 202). As non-limiting examples, the volumetric flow rate of coolant fluid through thermostat 204 may be 10, 15, or 20 gallons per minute. As shown, the flow of coolant fluid may be passed through multiple fluid outlet passages, 210 and 213, that may deliver coolant fluid to different engine components. In other embodiments, however, coolant fluid may be exited from thermostat 204 by only a single fluid outlet passage or more than two fluid outlet passages. Coolant fluid passed through thermostat 204 may be directed to components that may be mounted on the passenger side of a vehicle in which heat exchanger 202 is mounted. For example, coolant fluid exited by thermostat 204 may be diverted in parallel, in separate coolant fluid flows of substantially the same temperature, to an EGR cooler and to a transmission cooler, respectively. It should be appreciated, however, that coolant fluid passed through thermostat 204 may, in some embodiments, also be passed to components that are mounted on the driver side of the vehicle, or may be exclusively passed to components that are mounted on the driver side of the vehicle.

Coolant fluid received by and funneled through heat exchange portion 203, but not diverted to thermostat 204, may be passed to heat exchange portion 205 via a jumper pipe (not shown in FIG. 2). Additional heat energy may be removed from coolant fluid passing through heat exchange portion 205 via heat exchange conduits integral to heat exchange portion 205 (not shown in FIG. 2). Thus, coolant fluid that has been passed through heat exchange portion 203 and at least a portion of heat exchange portion 205 may be cooled to a temperature range lower than a temperature range of coolant fluid that has been passed through a portion of heat exchange portion 203 and then diverted to thermostat 204 (e.g., not passed on to heat exchange portion 205). The temperature of coolant fluid received from heat exchange portion 203 and passed through heat exchange portion 205 may thereby be reduced. As illustrated in FIG. 2, coolant fluid passed through and cooled by heat exchange portion 205 may then be received by thermostat 212, the temperature of the coolant fluid having been cooled to a temperature range that thermostat 212 is configured to pass there through. For example, thermostat 212 may be configured to allow coolant fluid at approximately 10° C. to pass there through (and thereby exit heat exchanger 202). As a non-limiting example, the volumetric flow rate of coolant fluid through thermostat 204 may be in the range of two to ten gallons per minute. As shown, the flow of coolant fluid may be passed through multiple fluid outlet passages, 214 and 215, that may deliver coolant fluid to different engine components. In other embodiments, however, coolant fluid may be exited from thermostat 204 by only a single fluid outlet passage or more than two fluid outlet passages. Coolant fluid passed through thermostat 212 may be directed to components that may be mounted on the driver side of a vehicle in which heat exchanger 202 is mounted. For example, coolant fluid exited by thermostat 204 may be passed out of the thermostat as a single coolant fluid flow, split into separate coolant fluid flows of substantially the same temperature, and then diverted to an air charge cooler and to a fuel cooler, respectively. It should be appreciated, however, that coolant fluid passed through thermostat 212 may, in some embodiments, also be passed to components that are mounted on the passenger side of the vehicle, or may be exclusively passed to components that are mounted on the passenger side of the vehicle.

By allowing for components that may operate more efficiently with coolant fluid provided within similar temperature ranges to be arranged near each other on one of the two sides of the vehicle (i.e., the driver side or the passenger side), the thermostat on the corresponding side of the heat exchanger may be arranged in closer proximity to these components. As such, shorter flow lengths, for example tube lengths, hose lengths, or pipe lengths, may be reduced and overall engine compartment space may be conserved.

Furthermore, although illustrated as being configured with airflow that is substantially perpendicular to the plane of the figure (i.e., a cross-flow configuration), in other embodiments, heat exchanger 202 may be configured with airflow that flows substantially parallel to the direction of coolant fluid flowing therein. For example, heat exchanger 202 may be configured with airflow that is substantially parallel to the flow of coolant fluid through the heat exchange portions. This may be manifested as a parallel flow arrangement (i.e., the direction of coolant fluid flow through a heat exchange portion substantially coincides with the direction of airflow through a particular heat exchange portion) or a counter current flow arrangement (i.e., the direction of coolant fluid flow through a heat exchange portion is substantially opposite to the direction of airflow through a particular heat exchange portion).

As discussed above, by arranging thermostats integral to heat exchange portions as illustrated in FIG. 2, porting between a heat exchange portion and a thermostat can be integral to the cooling system. In some embodiments, thermostats may be configured as modules that include a modular housing that may be snapped, screwed, or otherwise directly fastened to heat exchange portions. Correspondingly, heat exchange portions, in some embodiments, may include receiving locations that may be configured to receive a thermostat module that is snapped, screwed, or otherwise directly fastened to the heat exchange portion. Such a configuration may increase ease of manufacture and may allow for easier system maintenance and thermostat replacement. In one embodiment, each thermostat and/or heat exchange portion uses a common housing structure that may further increase modularity of the overall cooling system. Additionally, a jumper pipe used to fluidically couple heat exchange portions may be arranged integral to a thermostat. As such, the number of tubes, hoses, connections and associated leak paths may be reduced. In other words, rather than multiple heat exchangers being arranged separately from a heat exchanger at different locations within an engine compartment, example embodiments of the present disclosure described herein allow for a more compact, simpler, more reliable, and easier to manufacture cooling system. The overall cost of the cooling system described herein may thereby be reduced.

FIG. 3 illustrates a side view of cooling system 200 as a longitudinal cross-section with thermostats and porting shown in greater detail according to an embodiment of the present disclosure. As illustrated, cooling system 200 may include a heat exchanger 202 that may remove heat energy from a coolant fluid received form an internal combustion engine (not shown in FIG. 3) and/or coolant fluid received from another engine component (also not shown in FIG. 3). In some embodiments, heat exchanger 302 may be configured as a radiator with one, two, or other suitable number of heat exchange core sections therein. Cooling system 300 may further include thermostat 304 and thermostat 306 that are integral to heat exchanger 302. Cooling system 300 may further include electronic control unit 316 which may be configured to control valves (i.e., solenoid valves) internal to thermostats 304 and 306 in response to at least one engine operating parameter. Although shown as being configured with two thermostats integral to heat exchanger 302, other embodiments may have a heat exchanger with one, three, four or other suitable number of heat exchangers integral thereto. As shown, heat exchanger 302 may receive a coolant fluid from an internal combustion engine via coolant fluid inlet passage 303. In other embodiments, multiple coolant fluid passages may deliver coolant fluid to an individual thermostat. In yet other embodiments, multiple thermostats may receive coolant fluid from a single coolant fluid passage or from multiple coolant fluid passages.

As illustrated in FIG. 3, a flow of coolant fluid may be received from a pump by coolant fluid inlet passage 303. A portion of this coolant fluid flow may be diverted to thermostat 204 by coolant fluid passage 308. The remaining portion of the flow may be diverted to by-pass section 201. A portion of the coolant fluid flow received by by-pass section 201 may then be exited by heat exchanger 202 via coolant fluid outlet passage 312 (thus exiting heat exchanger 202 without passing though any heat exchange portions). Additionally, a portion of the coolant fluid exited by heat exchanger 202 via coolant fluid outlet passage 312 may be diverted to thermostat 212 via coolant fluid passage 313.

As illustrated in FIG. 3, a portion of the coolant fluid passed through by-pass section 201 may be diverted to heat exchange portion 203 where heat energy may be removed from the coolant fluid passing there through. A portion of the coolant fluid passed through heat exchange portion 203 may be diverted to thermostat 204 via coolant fluid passage 310. In some embodiments, thermostat 204 may be configured (or commanded by ECU) to allow only fluid of a single temperature range to pass there through. For example, coolant fluid received by thermostat 204 via coolant fluid passage 308 and coolant fluid passage 310 may mix inside thermostat 204 to produce a coolant fluid stream of a different temperature than the temperatures of the coolant fluid flows received via coolant fluid passages 308 and 310. Thermostat 204 may thus be configured to allow coolant fluid that is within a temperature range that may be achieved only when these two separate coolant fluid streams are mixed inside thermostat 204 (or in some embodiments, upstream of thermostat 204) to pass through thermostat 204. In other embodiments, thermostat 204 may be configured to allow coolant fluid streams of different temperature ranges to pass there through. For example, in addition to allowing a coolant fluid stream that is a combination of two separate coolant fluid flows (received from coolant fluid passages 308 and 310), thermostat 204 may be configured to (or commanded to by ECU 316) allow a coolant fluid flow stream of a temperature range typical of the fluid flow received from coolant fluid passage 308 or from coolant fluid passage 310 to pass through thermostat 204 when commanded by a control signal received by electronic control unit 316.

It should be appreciated that although shown in FIG. 3 as capable of receiving coolant fluid flow from two separate coolant fluid passages, 308 and 310, in other embodiments, thermostat 204 may be configured to receive coolant fluid flows from one, three, four, or other suitable number of coolant fluid passages. It should also be appreciated that although shown as separated from heat exchanger 202, in some embodiments, thermostat 204 (and fluid passages 308 and 310) may be integral to a housing (or housings) that is integral to heat exchanger 202. Thus, coolant fluid passage lengths may be reduced, the number of fluid passage connection points may be reduced, and overall ease of manufacturing may be improved. Furthermore, thermostat 204, coolant fluid passage 308, coolant fluid passage 310, and coolant fluid inlet passage 303 may be integral to a modular housing unit that in some embodiments may be installed as a single unit on heat exchanger 202. Additionally, the coolant fluid passages described herein may be configured as pipes, tubes, or hoses for example. Correspondingly, the cross-sectional shape of the coolant fluid passages described herein may be round, elliptical, rectangular, hexagonal, octagonal, or other suitable cross-sectional shape.

As illustrated in FIG. 3, coolant fluid passed through heat exchange portion 205 may then be received by thermostat 212 via coolant fluid passage 314. In some embodiments, thermostat 212 may be configured to (or commanded to by ECU 316) allow only fluid of a single temperature range to pass there through. For example, coolant fluid received by thermostat 212 via coolant fluid passage 313 and coolant fluid passage 314 may mix inside thermostat 212 to produce a coolant fluid stream of a different temperature than the temperature of the coolant fluid flows received via coolant fluid passages 313 and 314. Thermostat 212 may thus be configured to (or commanded to by ECU 316) allow coolant fluid that is within a temperature range that may be achieved only when these two separate coolant fluid streams are mixed inside thermostat 212 (or in some embodiments, upstream of thermostat 212). In other embodiments, thermostat 212 may be configured to allow coolant fluid streams of different temperature ranges to pass there through. For example, in addition to allowing a coolant fluid stream that is a combination of two separate coolant fluid flows (received from coolant fluid passages 313 and 314), thermostat 212 may be configured to (or commanded to by ECU 316) allow a coolant fluid flow stream of a temperature range typical of the fluid flow received from coolant fluid passage 313 or from coolant fluid passage 314 to pass through thermostat 212.

It should be appreciated that although shown in FIG. 3 as capable of receiving coolant fluid flow from two separate coolant fluid passages, 313 and 314, in other embodiments, thermostat 212 may be configured to receive coolant fluid flows from one, three, four, or other suitable number of coolant fluid passages. It should also be appreciated that although shown as separated from heat exchanger 202, in some embodiments, thermostat 212 (and fluid passages 313 and 314) may be integral to a modular housing (or housings) that is integral to heat exchanger 202. Thus, coolant fluid passage lengths may be reduced, the number of fluid passage connection points may be reduced, and overall ease of manufacturing and maintenance may be improved. Furthermore, thermostat 212, and/or coolant fluid passage 313, and/or coolant fluid passage 314, and/or coolant fluid outlet passage 312 may be integral to a modular housing unit that in some embodiments may be installed as a single unit on heat exchanger 202.

FIG. 4 illustrates a process flow for the transporting and processing of coolant fluid by cooling system 200 (as illustrated in FIG. 2). At 402, coolant fluid may be received by a heat exchanger from an engine or engine component via a pump and coolant fluid inlet passage. At 404, the coolant fluid flow may be received and passed through a by-pass section (which by-passes heat exchange portions integral to the heat exchanger and thus does not actively remove heat energy from coolant fluid flowing there through). At 406, a portion of the coolant fluid passed through the by-pass section may be discharged from the heat exchanger via a coolant fluid outlet passage. The remaining portion of the coolant fluid flow (i.e., the portion of the coolant fluid flow not discharged from the heat exchanger immediately after passing through the by-pass section) may then be diverted through a first heat exchange portion where heat energy may be removed there from. After passing through at least a portion of the first heat exchange portion, a sufficient amount of heat energy may have been removed from the coolant fluid stream such that the temperature of the coolant fluid has been cooled to within a temperature range that a first thermostat will allow the coolant fluid, which may be diverted to the first thermostat at 410, to pass through the first thermostat.

The remaining portion of the coolant fluid flow (i.e., the portion of the coolant fluid flow not discharged from the heat exchanger immediately after passing through the by-pass section) or passed through the first thermostat may then be diverted through a second heat exchange portion where heat energy may be removed there from. After passing through at least a portion of the second heat exchange portion, a sufficient amount of heat energy may have been removed from the coolant fluid stream such that the temperature of the coolant fluid has been cooled to within a temperature range that a first thermostat will allow the coolant fluid, (which may be diverted to the second thermostat at 412), to pass through the second thermostat.

Figure 5:
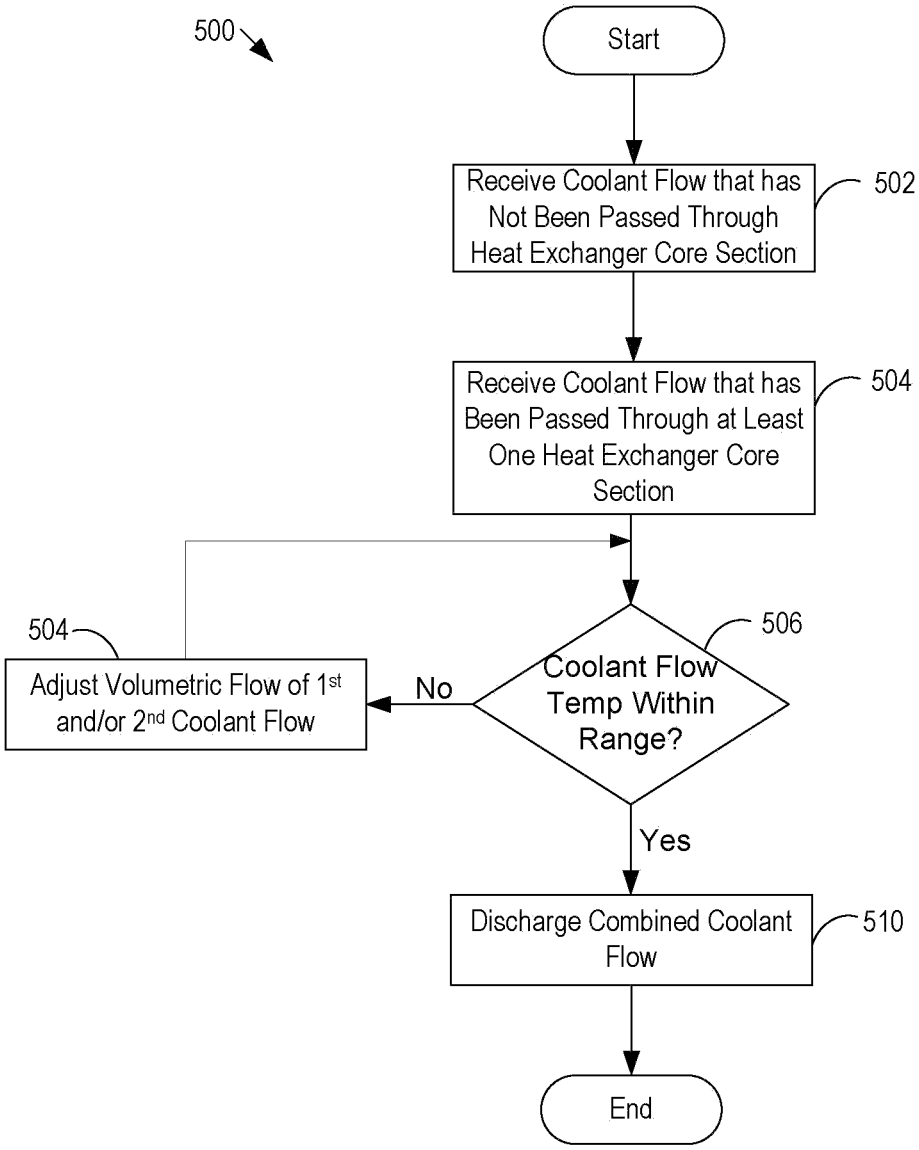
FIG. 5 illustrates a process flow for the processing of coolant fluid by a thermostat of the cooling system of FIG. 1 according to an embodiment of the present disclosure.

FIG. 5 illustrates a process flow for the processing of coolant fluid by a thermostat. At 502, the thermostat may receive a first coolant fluid flow that has not been passed through a heat exchange portion during the current cycle through the cooling system. For example, the thermostat may be configured such that it receives a flow of coolant fluid directly from a pump upstream of the cooling system or the thermostat may be configured such that it receives a flow of coolant fluid from a by-pass section integral to a heat exchanger. At 504, the thermostat may receive a second coolant fluid flow that has been passed through a portion of at least one heat exchanger portion where it may then mix the coolant fluid stream received by the thermostat at 502. It should be appreciated that in other embodiments or operating modes, the thermostat may be configured to receive and pass there through a single coolant fluid stream or three, four, or other suitable number of coolant fluid streams.

At 506, it may be determined whether the combined coolant fluid flow (i.e., the combination of the first and second coolant fluid flows) within the thermostat is within a temperature range that is allowed to pass through the thermostat. If the answer at 506 is no, then the volumetric flow rate of the first coolant fluid flow and/or the volumetric flow rate of the second coolant fluid flow may be adjusted so that the temperature of the combined coolant fluid flow is increased or decreased such that it is within the temperature range that the thermostat will allow it to pass there through. After the flow adjustment (s) at 508, it may again be determined at 506 whether the combined coolant fluid flow within the thermostat is within a temperature range that is allowed to pass through the thermostat. If the answer at 508 is again no, then the routine performs another iteration (and will continue to do so) until the temperature of the combined coolant fluid is within the appropriate temperature range. When the temperature of the combined coolant fluid flow has been determined to be within the appropriate temperature range (i.e., the answer at 506 is yes), the combined coolant fluid flow may be discharged from the thermostat and directed to the engine or engine component.

By arranging the thermostat and related coolant fluid passages integral to a heat exchanger as described above, the lengths of the coolant fluid passages may be reduced (in contrast to current technologies where thermostats are substantially spatially separate from a heat exchanger). As such, the temperature of the coolant fluid exited by a thermostat may be more closely controlled by virtue of the smaller distances between the heat exchanger by-pass and portions and the thermostat itself. A more reliable and efficient cooling system may thus be realized by the embodiments of the present disclosure described herein.

Note that with regards to vehicle applications, the various coolant fluid passages coupling the various cooling system components may include one or more bends or curves to accommodate a particular vehicle arrangement. Furthermore, the cross-sectional shapes of the various exhaust system components and the exhaust passage portions that couple the various exhaust system components may be circular, oval, rectangular, hexagonal, or any other suitable shape. Further still, it should be appreciated that in some embodiments, cooling system 100 may include additional components not illustrated in FIGS. 1-3 or may omit components described herein.

It should be appreciated that the configurations disclosed herein are exemplary in nature, and that these specific embodiments are not to be considered in a limiting sense, because numerous variations are possible. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A cooling system for cooling an engine, the cooling system comprising:

a heat exchanger, the heat exchanger including a first heat exchange portion that removes heat energy from coolant fluid flowing therein, and a second heat exchange portion that removes heat energy from coolant fluid flowing therein;

a first thermostat integral to the heat exchanger, the first thermostat fluidically and mechanically coupled to at least one of the first and second heat exchange portions; and a second thermostat integral to the heat exchanger, the second thermostat fluidically and mechanically coupled to at least one of the first and second heat exchange portions, and wherein each of the first and second thermostats are configured to receive coolant fluid flows from at least one of the first and second heat exchange portions.

2. The cooling system of claim 1, wherein the first thermostat and second thermostat are arranged at different locations with respect to the first heat exchange portion and with respect to the second heat exchange portion.

3. The cooling system of claim 1, wherein the heat exchanger further comprises a by-pass section that allows at least a portion of coolant fluid flowing through the heat exchanger to by-pass the first heat exchange portion and the second heat exchange portion.

4. The heat exchanger of claim 2, wherein the first thermostat receives a coolant fluid flow from the first heat exchange portion and diverts a portion of the coolant fluid flow to a transmission cooler.

5. The heat exchanger of claim 4, further comprising a controller that varies an amount of coolant fluid received by the first thermostat from the first heat exchange portion in response to an operating parameter.

6. The heat exchanger of claim 2, wherein the first thermostat receives a coolant fluid flow from the first heat exchange portion and receives a coolant fluid flow from a by-pass section and diverts a portion of the coolant fluid flow to a transmission cooler.

7. The heat exchanger of claim 4, wherein the second thermostat receives a coolant fluid flow that has been passed through the first heat exchange portion and at least some of the second heat exchange portion and diverts a portion of the coolant fluid flow to an air charge cooler.

8. The heat exchanger of claim 3, wherein the second thermostat receives a coolant fluid flow that has been passed through the first heat exchange portion and at least some of the second heat exchange portion and receives a coolant fluid flow from the by-pass section.

9. The heat exchanger of claim 7, wherein the coolant fluid flow received by the second thermostat that has been passed through the first heat exchange portion and at least some of the second heat exchange portion is in a lower temperature range than a temperature range of the coolant fluid flow received by the first thermostat from the first heat exchange portion.

10. A cooling system for cooling an engine, the cooling system comprising:

a first heat exchange core section that removes heat energy from coolant fluid flowing therein, a second heat exchange core section that removes heat energy from coolant fluid flowing therein, the second heat exchange core section being positioned downstream of the first heat exchange core section;

a plurality of receiving sections integral to the first and second heat exchange core sections; and a plurality of thermostat modules, each of the plurality of thermostat modules coupled to the first and second heat exchange core sections at one of the plurality of receiving sections, wherein one of the plurality of thermostat modules receives a coolant fluid flow from the first heat exchange core section, and wherein each of the thermostat modules are configured to receive coolant fluid flows from at least one of the first and second heat exchange core sections.

11. The cooling system of claim 10, wherein each of the plurality of thermostat modules are arranged at different locations with respect to the first heat exchange core section and with respect to the second heat exchange core section.

12. The cooling system of claim 10, further comprising a by-pass section that allows at least a portion of coolant fluid to by-pass the first heat exchange core section and to by-pass the second heat exchange core section.

13. The cooling system of claim 10, further comprising a controller that varies an amount of coolant fluid received by the one of the plurality of thermostat modules from the first heat exchange core section in response to an operating parameter.

14. The cooling system of claim 12, wherein one of the plurality of thermostat modules receives the coolant fluid flow from the first heat exchange core section and receives a coolant fluid flow from the by-pass section.

15. The cooling system of claim 10, wherein one of the plurality of thermostat modules receives a coolant fluid flow that has been passed through the first heat exchange core section and has been passed through at least some of the second heat exchange core section and diverts a portion of the coolant fluid flow to a fuel cooler.

16. The cooling system of claim 12, wherein one of the plurality of thermostat modules receives a coolant fluid flow that has been passed through the first heat exchange core section and at least some of the second heat exchange core section and receives a coolant fluid flow from the by-pass section.

17. A radiator for cooling an engine, the radiator comprising:

a coolant fluid inlet passage that receives a coolant fluid flow from the engine;

a by-pass section that receives a coolant fluid flow from the coolant fluid inlet passage;

a first heat exchange core section that receives a coolant fluid flow from the by-pass section and removes heat energy from coolant fluid flowing therein;

a second heat exchange core section that removes heat energy from coolant fluid flowing therein, the second heat exchange core section fluidically coupled to and located downstream of the first heat exchange core section;

a first thermostat module integral to the first heat exchange core section, that receives a coolant fluid flow that has been passed through the by-pass section and a portion of the first heat exchange core section and receives a coolant fluid flow from the coolant fluid inlet passage; and a second thermostat module integral to the second heat exchange section, that receives a coolant fluid flow that has been passed through the by-pass section and both the first heat exchange core section and the second heat exchange core section and receives a coolant fluid flow from the by-pass section.

18. The cooling system of claim 16, wherein the by-pass section allows at least a portion of coolant fluid to by-pass the first heat exchange core section and to by-pass the second heat exchange core section.

19. The cooling system of claim 18, wherein the coolant fluid flow received by the first thermostat module that has been passed through the by-pass section and a portion of the first heat exchange core section is in a temperature range that is higher than a temperature range of the coolant fluid flow received by the second thermostat module that has been passed through the by-pass section and both the first heat exchange core section and the second heat exchange core section.

* * * * *